US006494189B1

(12) United States Patent
Chu et al.

(10) Patent No.: US 6,494,189 B1
(45) Date of Patent: Dec. 17, 2002

(54) FLAME ARRESTOR SYSTEM FOR FUEL PUMP INLET

(75) Inventors: Yu-Sen James Chu, Westlake, OH (US); David J. Sandy, Avon, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/363,180

(22) Filed: Jul. 29, 1999

Related U.S. Application Data

(60) Provisional application No. 60/102,091, filed on Sep. 28, 1998.

(51) Int. Cl.[7] ..... F02M 37/04

(52) U.S. Cl. ..... 123/509; 123/198 D; 417/423.3

(58) Field of Search ..... 123/510, 509, 123/514, 516, 198 D; 417/423.3; 137/549

(56) References Cited

U.S. PATENT DOCUMENTS

| | | | | |
|---|---|---|---|---|
| 2,846,952 A | | 12/1958 | Ridland | |
| 3,038,410 A | | 6/1962 | Bell | |
| 3,434,336 A | | 3/1969 | Harr | |
| 3,635,599 A | | 1/1972 | Bryant et al. | |
| 3,658,444 A | * | 4/1972 | Rhodes et al. | 417/423.3 |
| 3,806,278 A | | 4/1974 | Grennan | |
| 3,841,520 A | | 10/1974 | Bryant et al. | |
| 3,889,649 A | | 6/1975 | Polaner | |
| 3,896,964 A | | 7/1975 | Takei et al. | |
| 3,911,949 A | | 10/1975 | Hilden et al. | |
| 3,947,362 A | | 3/1976 | Etani | |
| 3,954,092 A | | 5/1976 | Polaner | |
| 4,142,839 A | | 3/1979 | Davis et al. | |
| 4,268,289 A | | 5/1981 | Polaner | |
| 4,275,988 A | | 6/1981 | Kalashnikov et al. | |
| 4,426,190 A | | 1/1984 | Shapiro et al. | |
| 4,645,600 A | | 2/1987 | Filippi | |
| 4,671,060 A | | 6/1987 | Wilkens | |
| 4,676,463 A | | 6/1987 | Tansill | |
| 4,682,936 A | | 7/1987 | Suzuki et al. | |
| 4,763,632 A | * | 8/1988 | Andreasson | 123/510 |
| 4,813,445 A | | 3/1989 | Lu | |
| 4,877,368 A | | 10/1989 | Timperi et al. | |
| 5,015,156 A | | 5/1991 | Scholz | |
| 5,170,764 A | * | 12/1992 | Tuckey | 123/509 |
| 5,203,296 A | | 4/1993 | Hart | |
| 5,357,913 A | | 10/1994 | Okumura et al. | |
| 5,375,565 A | | 12/1994 | Maxson et al. | |
| 5,427,501 A | | 6/1995 | Chu | |
| RE35,404 E | | 12/1996 | Brown | |
| 5,709,187 A | | 1/1998 | Jaeger et al. | |
| 5,785,084 A | * | 7/1998 | Richter et al. | 137/549 |
| 5,787,865 A | * | 8/1998 | Harris et al. | 123/516 |
| 5,960,775 A | * | 10/1999 | Tuckey | 123/509 |
| 6,155,238 A | * | 12/2000 | Briggs et al. | 123/509 |

OTHER PUBLICATIONS

Department of Transportation, Federal Aviation Administration (Federal Register, Jul. 24, 1998 (vol. 63, No. 142) Proposed Rules, pp. 39765–39769.).

Article of Aerospace America entitled "What Happened to Flight 800" from the Mar. 1998 issue.

(List continued on next page.)

*Primary Examiner*—Carl S. Miller
(74) *Attorney, Agent, or Firm*—John A. Molnar, Jr.

(57) ABSTRACT

A flame arresting system for a centrifugal fuel pump of a variety including a downstream impeller and an upstream inlet port. The system includes an arrestor body which is received with the inlet port within an associated fuel tank. The body is formed of an open-cell foam material having an average pore size and thickness selected as being both fluid permeable and adapted to prevent flame from propagating therethrough. The inlet port is contained within the body such that fuel within the fuel tank may be drawn into the inlet port through the arrestor body, with flame being prevented from passing into the tank from the inlet port.

11 Claims, 2 Drawing Sheets

OTHER PUBLICATIONS

Proposed Rules, Federal Register, vol. 63, No. 77 dated Apr. 22, 1998.
Boeing Commercial Airplane Group Service Bulletin No. 747–28A2210 dated May 14, 1998.
Article from The Seattle Times dated Aug. 8, 1998 entitled Boeing Issues Warning of In–Tank Spark Hazard.
Pamphlet of Shaw Aero Devices, Inc. on Flame Arrestors (undated).
Technical Products Function Sheet of Foamex–Tech Products (undated).

* cited by examiner

FLAME ARRESTOR SYSTEM FOR FUEL PUMP INLET

RELATED CASES

The present application claims priority to U.S. Provisional Application Serial No. 60/102,091; filed Sep. 28, 1998.

BACKGROUND OF THE INVENTION

The present invention relates generally to flame arrestors, and more particularly to a flame arrestor arrangement for the inlet tube or other intake of an aircraft fuel pump.

Aircraft fuel systems conventionally employ multiple fuel tanks which may be mounted onboard in the wing or fuselage. The tanks typically are connected by transfer tubes, and by venting ducts which maintain atmospheric pressure in the tanks under normal flow conditions. In many fuel systems, transfer pumps are mounted on wing spars outside the wings to move fuel from one tank to another in order to "trim" the aircraft. Smaller, "scavenge" pumps also may be provided within the tanks to empty residual fuel after the remainder of the fuel has been drawn down to the level of the inlets of the principal transfer pumps. Pumps also are used to transfer fuel from remote tanks to the engine.

Accordingly, a number of fuel pumps, which may be mounted externally of the tank or, alternatively, internally mounted and submersed within the tank, typically are carried as on-board equipment in any given aircraft. In basic construction, aircraft fuel pumps conventionally are of a centrifugal-design employing a motor and an impeller which are enclosed within a housing. The motor is operably connected to the impeller via a drive shaft or the like, with the impeller, in turn, being coupled in fluid communication with inlet and outlet ports of the pump. During operation, the motor rotatably drives the impeller which develops a pressure drop drawing fuel or other working fluid from the associated tank through the pump inlet port and discharging the fuel, now under pressure, through the pump outlet port.

In a common construction, the impeller is provided as having an axially-extending hub or stem which is coupled to the drive shaft of the motor. Radially-extending, helical vanes are formed integrally with the hub and are enclosed by an axially-extending, generally cylindrical sleeve. The rotation of the impeller vanes within the sleeve draws the fuel or other liquid fluid into a volute chamber formed within the housing. The volute chamber converts the kinetic energy imparted to the fuel by the impeller into pressure for the discharge of the fluid through the pump outlet. Centrifugal pumps are available from a wide variety of manufacturers, including the Airborne Division of Parker-Hannifin Corp., Elyria, Ohio. Representative centrifugal pumps also are shown in commonly-assigned Chu, U.S. Pat. No. 5,427,501; Scholz, U.S. Pat. No. 5,015,156; and Lu, U.S. Pat. No. 4,813,445, as well as in Timperi et al., U.S. Pat. No. 4,877,368; Shapiro et al., U.S. Pat. No. 4,426,190; Kalashnikov, U.S. Pat. No. 4,275,988; Davis et al., U.S. Pat. No. 4,142,839; Carter, U.S. Pat. No. 3,652,186; Grennan, U.S. Pat. No. 3,806,278; Bell, U.S. Pat. No. 3,038,410; and Ridland, U.S. Pat. No. 2,846,952.

As aforementioned, certain centrifugal pumps used within aircraft fuel systems are mounted within the tank and therefore are termed in-tank or "wet" pumps. These pumps typically are oriented vertically within the tank, with the pump motor being located above the impeller in the direction of fuel flow. A certain minimum floor clearance generally is maintained between the impeller vanes and the bottom wall or floor of the tank to provide efficient pumping of fluid. Exemplary "wet" pumps are shown in U.S. Pat. Nos. 5,427,501; 5,015,156; and 2,846,952.

Alternatively, and as also was aforementioned, certain other centrifugal pumps used within aircraft fuel systems are mounted externally of the tank and therefore are termed "dry" pumps. These pumps, in contrast to wet pumps, may be oriented horizontally relative to the tank floor and mounted externally to the outside of the tank or to an adjacent support. A generally downwardly depending inlet tube, snorkel, hose or the like may be provided to extend in fluid communication from the pump impeller to a remote inlet port opening disposed above the tank floor. An exemplary "dry" pump is shown in U.S. Pat. No. 4,142,839.

With fuel pumps of either variety, spark generation and propagation into the fuel tank are major safety concerns. In this regard, it is known that during dry operation of the pump, such as with an empty fuel tank, it is possible to generate a spark caused by a dragging impeller or by debris trapped between the impeller and its surrounding sleeve. Although not known ever to have occurred, there exists at least the potential for the spark to propagate from the pump inlet into the fuel tank wherein the possibility for explosive combustion of residual fuel vapor exists. Proposed fuel pump constructions purporting to minimize spark generation and flame propagation are shown in Suzuki et al., U.S. Pat. No. 4,682,936 and Brown, U.S. Pat. No. Re. 35,404. Other techniques for improving the flame resistance of aircraft fuel systems and of combustion or turbine engines, or pumps in general are described in U.S. Pat. Nos. 5,709,187; 5,375,565; 5,357,913; 5,203,296; 4,671,060; 4,645,600; 4,676,463; 4,268,289; 3,947,362; 3,889,649; 3,911,949; 3,954,092; 3,841,520; 3,896,964; 3,635,599; and 3,434,336.

Proposals have been made for the use of flame arrestors for aircraft applications. In basic design, such arrestors are constructed as having a flame arresting element formed of a stainless steel or titanium material having a hexagonal honeycomb or a rectangular cell structure. The element, typically mounted in a housing, is installed within a fuel vent line, tank, or pump inlet to act as a barrier preventing a moving flame front from propagating into a location such as a fuel cell which may contain an explosive air/fuel mixture, while allowing for the flow of fuel or air to occur with minimal pressure drop. In having a surface area and material mass, the arrestor element functions to effect the transfer of heat from the flame front such that the temperature of the flammable mixture falls below its ignition temperature. In this way, the propagation of the flame is arrested. Commercial flame arrestors for aircraft applications are marketed by Shaw Aero Devices, Inc., Fort Myers, Fla.

Recently, concerns have been expressed over the possibility that a spark generated at a fuel pump inlet by a dragging impeller or otherwise could be propagated into the fuel tank. Indeed, it has been speculated by Tischler in Aerospace America (March, 1998), and by Taylor in the Seattle Times News (Aug. 8, 1998) that an in-tank fuel pump could have played a role in the TWA Fight 800 disaster of 1996. In response, Boeing has issued a Service Bulletin, No. 7474-28A2210 (May 14, 1998), which provides instructions in the installation of a flame arrestor at the open end of the inlet tube of the scavenge pump for the center wing tank. The United States Federal Aviation Administration also has proposed adding new airworthiness directives to 14 C.F.R. Part 39 which would make the installation of such a flame arrestor a requirement. It therefore is to be expected that a flame arrestor design which addresses such a possibility in a cost-effective manner would be well-received by the aviation industries.

BROAD STATEMENT OF THE INVENTION

The present invention is directed to a flame arresting arrangement particularly adapted for use within the fuel system of an aircraft. Within such fuel systems, a centrifugal pump is conventionally provided as including a downstream impeller and an upstream inlet port coupled in fluid communication with the impeller as received within an associated fuel tank. In accordance with the present invention, a flame arrestor body is received with the inlet port within the fuel tank. Such body is formed of an open cell, i.e., reticulated, foam material which may be a polyether- or polyester-based polyurethane elastomer. The foam has an average pore size and thickness selected as being both fluid permeable and adapted to prevent flame from propagating therethrough. With the inlet port being contained within the arrestor body, fuel within the tank may be drawn into the inlet port through such body, with any flame or spark generated by the pump impeller or otherwise being prevented from passing from the inlet port into the fuel tank. In this way, the potential of a fuel vapor ignition is reduced. Advantageously, the reticulated foam body functions both as a flame arresting device and as a fuel filter for the pump.

In a preferred embodiment, the body is configured as a shroud for the inlet port. Specifically, a downstream, first end portion of the body is configured to define an end wall portion, with a terminal end face of an opposing, upstream end portion being abuttingly supported on an interior surface of the tank and being configured as having a generally annular cross-sectional geometry. The body further extends along a central axis of the inlet port from the end face to the end wall as forming a circumferential side wall portion. The inlet port thereby is enclosed within an internal plenum defined by the end and side wall portions of said body and the interior surface of said tank. Such a construction presents a greater surface area of the body to the respective flame and fluid fronts without a corresponding increase in foam thickness. Accordingly, the potential for fouling from particulates entrained in the fuel or from "icing" caused by the condensation of supercooled fuel on the body is reduced without an appreciable increase in the pressure drop or other flow restriction though the body.

Such a construction, moreover, is adaptable to accommodate fuel pumps of either a "wet" or "dry" type. In this regard, the body end wall may be configured as having an aperture adapted to receive either the inlet tube of a dry, externally-mounted fuel pump, or the housing of a wet, internally-mounted pump. In a particularly preferred embodiment, the body is supported within a metal mesh outer layer which also functions to distribute fuel across the outer surface of the body.

It is, therefore, a feature of a disclosed embodiment of the present invention to provide a flame arresting system for a fuel pump of an aircraft or the like. Such pump conventionally is of a centrifugal variety which includes a downstream impeller and an upstream inlet port having a central axis, the inlet port being coupled in fluid communication with the impeller and being received within an associated fuel tank as disposed adjacent an interior surface thereof. The arresting system includes an arrestor body received with the inlet port within the fuel tank. Such body is formed of an open-cell foam material having an average pore size and thickness selected as being both fluid permeable and adapted to prevent flame from propagating therethrough. The pump inlet port is contained within the body such that fuel within the tank may be drawn into the inlet port through the arrestor body, with flame being prevented from passing into the fuel tank from the inlet port.

The present invention, accordingly, comprises the system possessing the construction, combination of elements, and arrangement of parts which are exemplified in the detailed disclosure to follow. Advantages of the invention includes a flame arresting system which is particularly adapted for aircraft applications, which may accommodate existing fuel pumps of either a wet or dry type. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

Figure 1:
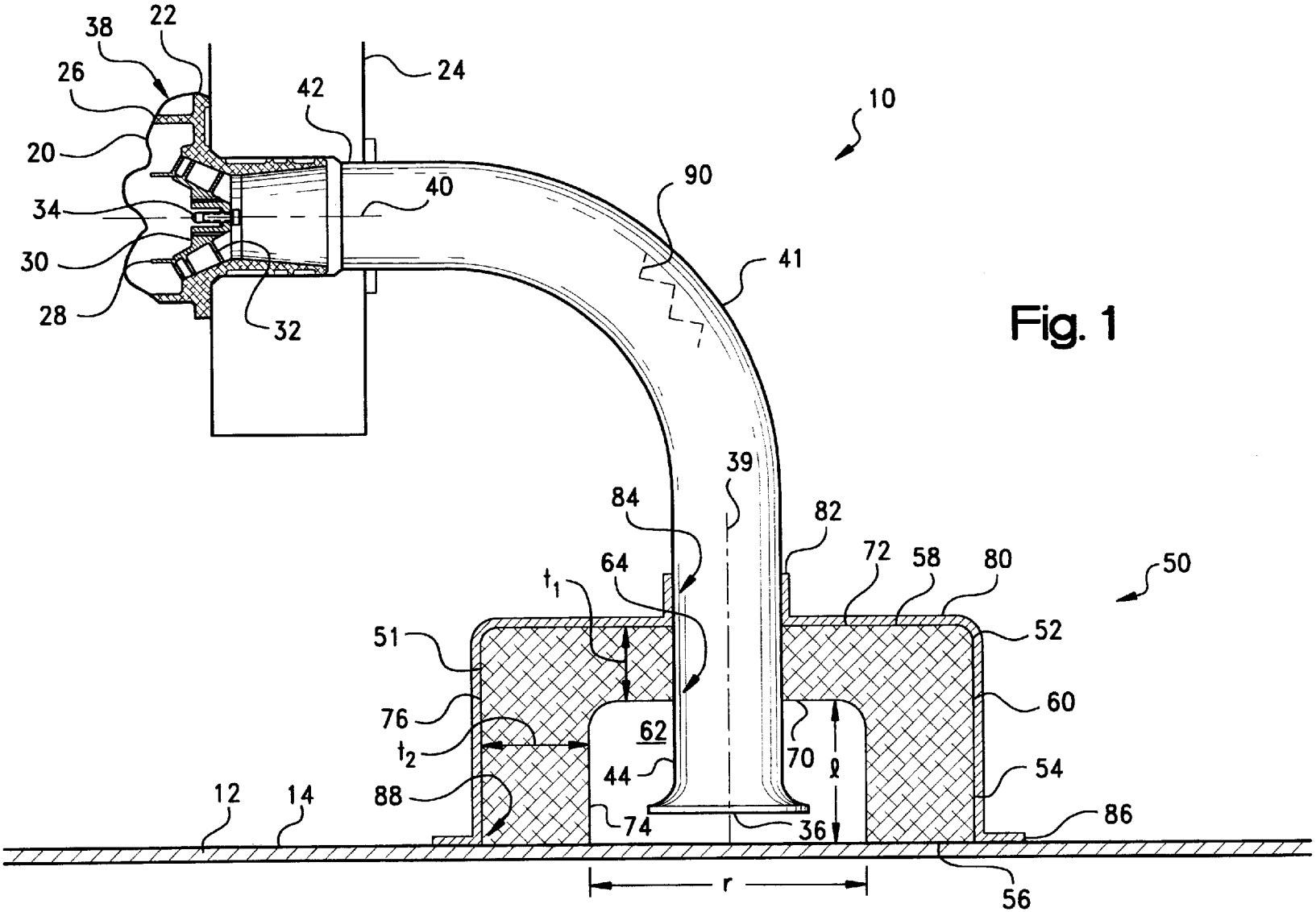
FIG. 1 is partially cross-sectional and fragmentary, somewhat schematic plan view of a representative embodiment of flame arresting system in accordance with the present invention as adapted for use with an aircraft fuel pump of an external, "dry" variety.

The drawings will be described further in connection with the following Detailed Description of the Invention.

DETAILED DESCRIPTION OF THE INVENTION

Certain terminology may be employed in the following description for convenience rather than for any limiting purpose. For example, the terms "forward," "rearward," "right," "left," "upper," and "lower" designate directions in the drawings to which reference is made, with the terms "inward," "inner," or "inboard" and "outward," "outer," or "outboard" referring, respectively, to directions toward and away from the center of the referenced element, the terms "radial" and "axial" referring, respectively, to directions or planes perpendicular and parallel to the longitudinal central axis of the referenced element, and the terms "downstream" and "upstream" referring, respectively, to directions in and opposite that of fluid flow. Terminology of similar import other than the words specifically mentioned above likewise is to be considered as being used for purposes of convenience rather than in any limiting sense.

For the illustrative purposes of the discourse to follow, the precepts of the flame arrestor system of the present invention are described in conjunction with its adaptation for installation with the fuel system of an aircraft having a fuel tank and an associated wet or dry fuel pump. In view of the discourse to follow, however, it will be appreciated that aspects of the present invention may find utility in other fluid systems, such as for ground transport vehicle applications involving fuel pumps. Use within those such other applications therefore should be considered to be expressly within the scope of the invention herein involved.

Referring then to the figures wherein corresponding reference characters are used to designate corresponding elements throughout the several views, with equivalent elements being referenced with prime designations, shown generally at 10 in FIG. 1 are the pertinent aspects of a representative fuel system for use in conjunction with a gas turbine or other engine of an aircraft or the like. Fuel system 10 conventionally includes a fuel tank, the bottom wall or floor of which is shown at 12 as having an interior surface, 14, and an associated fuel transfer pump, 20. For illustrative purposes, fuel pump 20 is shown to be of an external or "dry" variety having a housing, 22, which is mounted externally of the fuel tank via a mounting plate, 24.

In a typical construction, housing 22 encloses a motor (not shown) and extends to define a lower sleeve portion, 26, which surrounds an impeller, 28. Impeller 28 is integrally formed as having a central hub portion, 30, and a plurality of radially-outwardly extending vanes, one of which is designated at 32. A shaft, 34, is received through hub portion 30 for rotatably coupling impeller 28 to the motor. Impeller 28 is coupled in fluid communication intermediate an upstream inlet port, 36, which is disposed internally within the tank immediately adjacent tank floor interior surface 14, and a downstream volute chamber, 38, which, in turn, is coupled in fluid communication with an outlet port (not shown) of pump 20. As will be appreciated, inlet port 36 is disposed relative to a central port axis, 39, above the surface 14 of the tank floor 12 with a tight clearance therebetween so as to maintain port 36 below the fuel level and to minimize the amount of residual fuel which otherwise would remain in the tank as below the level of the port.

Further in the external or "dry" application shown in FIG. 1, with the longitudinal axis, 40, of pump 20 being generally horizontally positioned relative to tank floor 12, an inlet tube or snorkel, 41, is provided to depend downwardly therefrom. That is, inlet tube 41 extends internally within the tank from a downstream, proximal end, 42, coupled in fluid communication with impeller 28, to an upstream, distal end, 44, terminating at an opening which defines inlet port 36.

In accordance with the precepts of the present invention, a flame arrestor system, referenced generally at 50, is provided for pump 20 whereby inlet port 36 thereof is contained within an arrestor body, 51, which itself is received in the fuel tank with inlet tube 41. In basic construction, arrestor body 51 is formed of an open-cell, i.e., reticulated foam material having an average pore size and thickness which is selected as being both fluid permeable and adapted to prevent sparks or other ignition sources or flames from propagating therethrough. Advantageously, with inlet port 36 being contained within the arrestor body 51, fuel within the tank may be drawn into the port through the arrestor body, with flame, sparks, or other ignition sources being prevented from passing into the fuel tank from the port. Body 51 thereby functions both as a flame arrestor, and as a depth-type fluid filter in effecting the separation of particulate contaminates from the fuel being drawn therethrough into inlet port 36.

Materials suitable for molding, extruding, or otherwise forming arrestor body 51 may be selected from any of the known polymeric foam materials characterized as "flame retardant" in having an open cell pore network of a size and tortuosity such that as flame moves through the interstices thereof, it is cooled to a temperature below its gas flame combustion point and thereby is extinguished. Generally, such materials, which may be chemically or mechanically foamed, will have a density of between about 1–2 lbs/ft$^3$, with an average pore size of between about 10–50 pores per inch (ppi) (4–20 pores per cm). Flame retardancy of the material itself may be imparted by loading the foam composition with between about 30–50% by weight of one or more conventional flame retardant additives such as aluminum hydrate, antimony trioxide, phosphate esters, or halogenated compounds such as polybrominated diphenyl oxides. Although any such foams, including flexible or rigid, may be used, an elastomeric polyether- or polyester-based polyurethane foam may be considered preferred. Polyurethane foams are further described in U.S. Pat. Nos. 3,946,039; 3,862,282; 3,753,756; and 3,171,820, with foam of the preferred type being available commercially from Foamex International Inc., Linwood, Pa. Alternative, albeit somewhat less-preferred materials include foamed polyethylenes, polypropylenes, polypropylene-EPDM blends, butadienes, styrene-butadienes, nitrites, chlorosulfonates, neoprenes, and silicones.

In the preferred embodiment illustrated in FIG. 1, arrestor body 51 is configured as a shroud for inlet port in extending generally coaxially along the inlet port axis 39 intermediate a downstream, first end portion, 52, disposed a spaced apart-distance from the tank interior surface 14, and an upstream, second end portion, 54, having a terminal end face, 56, which is abuttingly supported on the tank surface 14. Further in this regard, first end portion 52 further extends radially outwardly from the port axis 39 to define an end wall portion, 58, of the shroud, with terminal end face 56 being configured as having a generally annular cross-sectional geometry such that the arrestor body 51 extends along axis 39 from end face 56 to end wall 58 as forming a circumferential side wall portion, 60, of the shroud. Inlet port 36 thereby may be disposed intermediate the body first and second end portions 52 and 54 of body 51 as enclosed within an internal, generally cylindrical plenum, 62, defined by the body end and side wall portions 58 and 60, and the tank interior surface 14. Accordingly, end wall 58 is provided as having a central aperture, 64, through which inlet tube 41 may be received into plenum 62.

The exact depth or thickness of the foam which is necessary to arrest the passage of flame therethrough is application specific to the pump installation, and generally will depend upon the performance requirements for the pump and upon other factors such as the volume and composition of the explosive fuel component or mixture, the area of the foam surface exposed to the flame front, the pressure drop through the foam, and the shape and size of the fuel tank. For most fuel transfer applications, however, the thickness of arrestor body 51 will be between about 3–6 inches (7–15 cm).

Specifically, in the shroud configuration shown in FIG. 1, end wall 58 has an inner and outer surface, 70 and 72, respectively, which define a first thickness dimension, $t_1$, therebetween. Side wall 60, in turn, has an inner and outer surface, 74 and 76, respectively, which define a second thickness dimension, $t_2$, therebetween which may be less than, about equal to, or, as is shown, greater than dimension t,. In other dimensions, plenum 62 may be configured to define an axial dimension, referenced at "l," between the end wall inner surface 70 and the tank interior surface 14, and to define a radial dimension, referenced at "r," taken along the inner diametric extent of side wall 60.

Further in the preferred shroud embodiment of FIG. 1, arresting system 50 additionally includes a fluid permeable outer layer, 80, which is conformably disposed on the outer surfaces 72 and 76 of the body end and side wall portions 58 and 60. Outer layer 80 may be formed of a relatively thin, mild steel, aluminum, brass, copper, stainless steel, or other metal mesh material. Such material may be selected as having a pore size of between about 0.05–0.13 inch (1.27–3.30 mm) to be relatively porous for admitting fluid into arrestor body 51. The material also may be selected to exhibit a transverse pressure drop, i.e., in a direction parallel to its surface, that is less than the pressure across body 51, i.e., in a direction perpendicular to its surface, for promoting a more uniform distribution of fluid across the corresponding surfaces of body 51.

Body 51 may be foamed-in-place within outer layer 80 to be self-adhesively bonded thereto. Alternatively, body 51 may be formed separately and then bonded to outer layer 80 using an adhesive, or otherwise mechanically joined with outer layer 80 in an interference fitting engagement.

For the attachment of body 51 to inlet tube 41 and tank floor 12, outer layer 80 may be formed as having a generally vertically-oriented downstream, i.e., upper flange portion, 82, which extends generally parallel to port axis 39 in defining an upper opening, 84, disposed in registration with body end wall aperture 64, and a generally horizontally-oriented upstream, i.e., lower flange portion, 86, which extends generally perpendicular to port axis 39 in defining a lower opening, 88, circumferentially disposed about body terminal end face 56. Flanges 82 and 86 may be brazed or otherwise affixed, respectively, to inlet tube 41 and tank interior surface 14, for securing body 51 therebetween.

In service, should a spark, flame, or other ignition source, referenced in phantom at 90, be contained within inlet tube 90 as generated by pump 20 or otherwise, the propagation of such spark into the fuel tank from inlet port 36 is arrested by body 51. That is, as ignition source 90 travels from inlet port 36, its propagation through body 51 is arrested by the open cellular foam structure thereof. The source thus is extinguished within body 51 and is prevented from propagating through the tank wherein it could contact a potentially explosive fuel and gas mixture.

Figure 2:
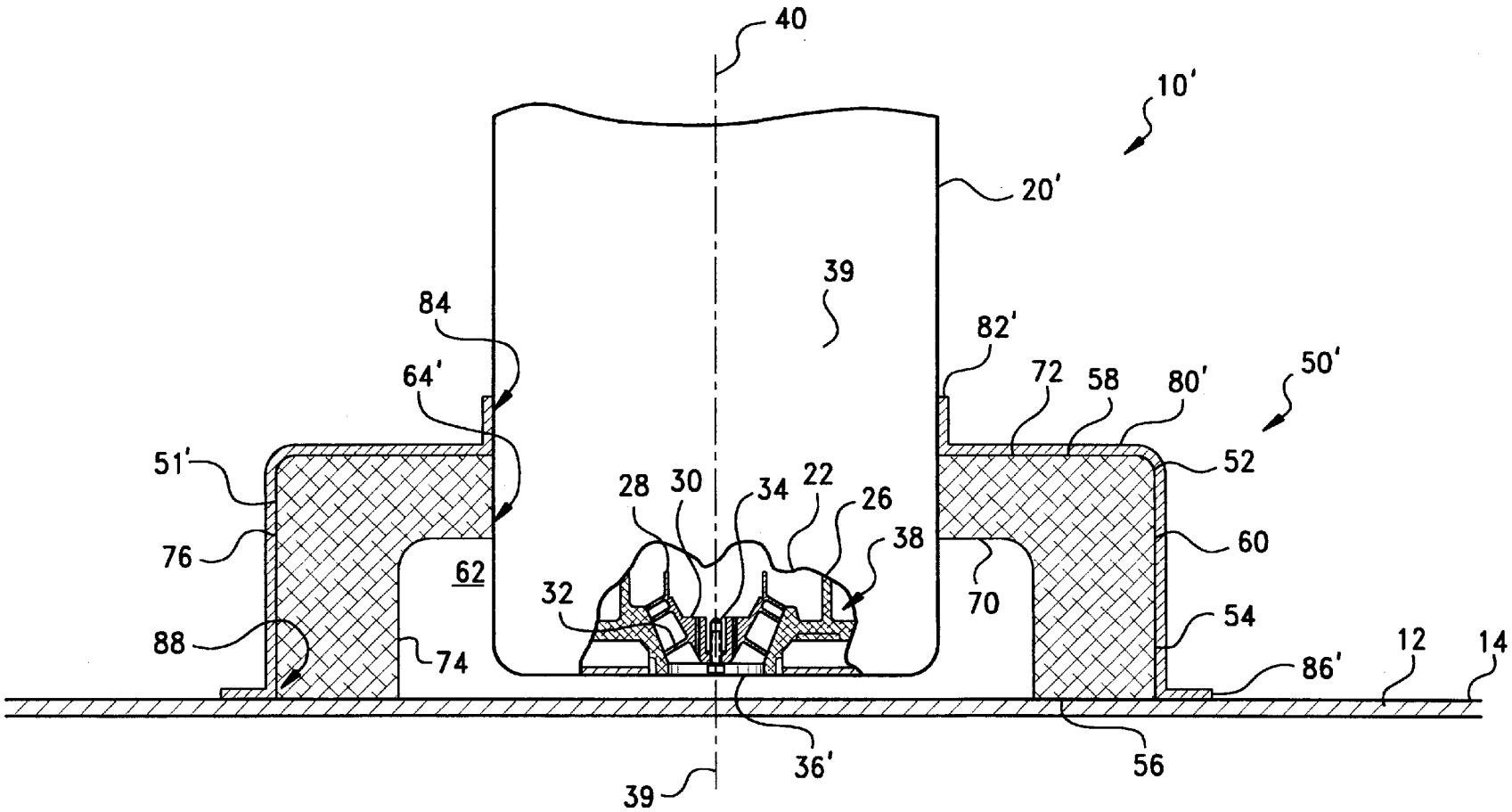
FIG. 2 is a partially cross-sectional and fragmentary, somewhat schematic plan view of another representative embodiment of a flame arresting system in accordance with the present invention as adapted for use with an aircraft fuel pump of an internal, "wet" variety.

Turning next to FIG. 2 wherein the pertinent aspects of another representative fuel system are depicted at 10', an alternative embodiment of flame arresting system 50 is shown at 50' as adapted for use in connection with a submersible or "wet" transfer pump, 20'. Pump 20' is received internally within the fuel tank with the axis 40 thereof being oriented generally vertically relative to the tank floor 12. As with external pump 20, internal pump 20' includes a housing, 22', which encloses a motor (not shown) and which extends to define a lower sleeve portion 26 which surrounds an impeller 28. As before, impeller 28 is integrally formed as having a central hub portion 30 and a plurality of radially-outwardly extending vanes 32. A shaft 34 is received through hub portion 30 for rotatably coupling impeller 28 to the motor.

Impeller 28 further is coupled in fluid communication intermediate an upstream inlet port, 36', and a downstream volute chamber 38. Inlet port 36' is defined by a corresponding opening within housing 22' and is disposed within the tank immediately adjacent tank floor interior surface 14. That is, inlet port 36' again is disposed relative to a central port axis 39 above the surface 14 of the tank floor 12 with a tight clearance therebetween so as to maintain port 36' below the fuel level and to minimize the amount of residual fuel which otherwise would remain in the tank as below the level of the port. Volute chamber 38, in turn, is coupled in fluid communication with an outlet port (not shown) of the pump 20'.

For the internal or "wet" transfer pump application shown in FIG. 2, arrestor body 51 is configured generally as in FIG. 1. As is shown at 51', however, body 51 is modified in system 50' to include an enlarged aperture 64, referenced at 64', configured to receive pump housing 22' therethrough disposing inlet port 36' within plenum 62 intermediate the first and second end portions 52 and 54 of body 51'. As before, with inlet port 36' being contained within the arrestor body 51', fuel within the tank may be drawn into the port through the arrestor body, with flame ignition sources being prevented from passing into the fuel tank from the port. Body 51' thereby again functions both as a flame arrestor, and as a depth-type fluid filter in additionally effecting the separation of particulate contaminates from the fuel being drawn into inlet port 36'.

As with system 50 of FIG. 1, arresting system 50' of FIG. 2 also includes a fluid permeable outer layer 80' which is conformably disposed on the outer surfaces 72 and 76 of the body end and side wall portions 58 and 60. For the attachment of body 51' to housing 22' and tank floor 12, outer layer 80' which, similar to outer layer 80, is formed as having a generally vertically-extending upper flange portion 82' and a generally horizontally-extending lower flange portion 86'. Flanges 82' and 86' likewise may be brazed or otherwise affixed, respectively, to pump housing 22' and tank interior surface 14, for securing body 51' therebetween.

As it is anticipated that certain changes may be made in the present invention without departing from the precepts herein involved, it is intended that all matter contained in the foregoing description shall be interpreted as illustrative and not in a limiting sense. All references cited herein are expressly incorporated by reference.

What is claimed is:

1. A flame arresting system for a centrifugal fuel pump of a variety including a downstream impeller and an upstream inlet port having a central axis, said inlet port being coupled in fluid communication with said impeller and being received within an associated fuel tank as disposed adjacent an interior surface thereof, said system comprising an arrestor body received with said inlet port within said fuel tank, said body having an internal plenum and being formed of an open-cell foam material having an average pore size and thickness selected as being both fluid permeable and adapted to prevent flame from propagating therethrough, and said arrestor body extending generally coaxially along the central axis of said inlet port intermediate a downstream first end portion disposed a spaced-apart distance from the tank interior surface and an upstream second end portion having a terminal end face, the body first end portion extending radially outwardly from the central axis of said inlet port to define an end wall of said body, and wherein said terminal end face of said body second end portion is configured as having a generally annular cross-sectional geometry such that said body extends along the central axis from said end face to said end wall as forming a circumferential side wall, said plenum being defined by the end and side walls of said body and the interior surface of said tank, said inlet port being contained within said plenum intermediate the first and second end portions of said body such that fuel within said tank may be drawn into said inlet port through said arrestor body with flame being prevented from passing into said fuel tank from said inlet port.

2. The flame arresting system of claim 1 wherein said foam material has an average pore size of between about 10–50 pores per inch (4–20 pores per cm).

3. The flame arresting system of claim 2 wherein said foam material comprises a polyether-based or polyester-based polyurethane elastomer.

4. The flame arresting system of claim 1 wherein said terminal end face of the arrestor body second end portion is abuttingly supported on the interior surface of said tank.

5. The flame arresting system of claim 1 wherein said end wall has an inner and outer surface defining a first thickness dimension therebetween, and wherein said side wall has an inner an outer surface defining a second thickness dimension therebetween.

6. The flame arresting system of claim 5 wherein said plenum defines an axial dimension between the inner surface of said end wall and the interior surface of the tank, and a radial dimension along an inner diametric extent of said side wall.

7. The flame arresting system of claim 1 wherein said body has an outer surface, and wherein said system further comprises a metal mesh outer layer disposed on the outer surface of said body.

8. The flame arresting system of claim 1 wherein said pump further includes a inlet tube extending into said tank from said impeller to said inlet port, said end wall of said body having an aperture, and said inlet tube being received through said aperture disposing said inlet port within the plenum of said body.

9. The flame arresting system of claim 8 wherein said body end and side wall each has an outer surface, and wherein said system further comprises a metal mesh outer layer disposed on the outer surfaces of said body end and side wall, said outer layer being formed as extending intermediate a downstream first flange portion extending generally parallel to the central axis of said inlet portion about a first opening of said outer layer disposed in registration with the body end wall aperture, and an upstream second flange portion extending generally perpendicular to the central axis of said inlet portion about a second opening of said outer layer disposed circumferentially about the terminal end face of said body second end portion, said outer layer first flange portion being joined to said inlet tube, and said second flange portion being joined to the tank interior surface.

10. The flame arresting system of claim 1 wherein said pump further includes a pump housing which extends over said inlet port, said end wall of said body having and aperture, and said housing being received through said aperture disposing formed said inlet port within the plenum of said body.

11. The flame arresting system of claim 10 wherein said body end and side wall each has an outer surface, and wherein said system further comprises a metal mesh outer layer disposed on the outer surfaces of said body end and side wall, said outer layer being formed as extending intermediate a downstream first flange portion extending generally parallel to the central axis of said inlet portion about a first opening of said outer layer disposed in registration with the body end wall aperture, and an upstream second flange portion extending generally perpendicular to the central axis of said inlet portion about a second opening of said outer layer disposed circumferentially about the terminal end face of said body second end portion, said outer layer first flange portion being joined to the pump housing, and said second flange portion being joined to the tank interior surface.

* * * * *